United States Patent [19]

Melander

[11] 4,194,247

[45] Mar. 25, 1980

[54] WEARABLE VENTILATION SYSTEM

[75] Inventor: Clarence Melander, Newark, Del.

[73] Assignee: East Wind Industries, Inc., Dover, Del.

[21] Appl. No.: 846,947

[22] Filed: Oct. 31, 1977

[51] Int. Cl.[2] ..... A41D 13/00

[52] U.S. Cl. ..... 2/2; 2/DIG. 1

[58] Field of Search ..... 2/2, 44, 2.1 R, 2.1 A, 2/DIG. 1; 128/142.5, 142.7; 98/DIG. 7

[56] References Cited

U.S. PATENT DOCUMENTS

| | | | |
|---|---|---|---|
| 39,237 | 7/1863 | Mayall | 98/DIG. 7 |
| 1,005,569 | 10/1911 | De Meir | 2/2 X |
| 2,144,611 | 1/1939 | Biggs | 2/2 |
| 2,649,583 | 8/1953 | Schaeffer | 2/2 |
| 2,709,667 | 5/1955 | Grubb et al. | 2/2 X |
| 2,989,752 | 6/1961 | Sloane et al. | 2/2.1 R |
| 3,345,641 | 10/1967 | Jennings | 2/2.1 R |
| 3,348,236 | 10/1967 | Copeland | 2/2 |
| 3,496,703 | 2/1970 | MacLeod et al. | 2/2 X |
| 3,568,209 | 3/1971 | O'Neill et al. | 2/2.1 R |
| 3,648,289 | 3/1972 | Moreland | 2/2.1 R |
| 3,675,244 | 7/1972 | Mayo et al. | 2/2.1 R |
| 3,921,223 | 11/1975 | Hoyecki | 2/DIG. 1 |

*Primary Examiner*—Werner H. Schroeder
*Assistant Examiner*—Moshe I. Cohen
*Attorney, Agent, or Firm*—John J. Kane; Frederick A. Zoda; Albert Sperry

[57] ABSTRACT

A ventilation system to be worn by an individual whenever cooling of the external surface of his body is required such as when wearing an industrial protective garment such as a rain suit which comprises a manifold for receiving ventilating gas and distributing the gas which includes an inlet in the manifold and an outlet from the manifold for receiving and distributing ventilating gas, the outlet is selectively connected to at least one gas distribution conduit which is formed of flexible fabric material and extends over the surface of the body of the wearer, the gas distribution conduits include a plurality of orifices in the surface thereof to provide controlled distribution of the ventilating gas, the gas distribution conduits can be formed of a woven fabric material which is coated with a gas impervious elastometer such as butyl rubber or the like to prevent the exiting of gas from the gas distribution conduits except at the locations of the prechosen orifices, the system may include simply two conduits extending from the rear of a person's waist over his shoulders to the front of a person's waist or may involve individual connections for the arms and legs of the wearer as well as an individual conduit for the head area of the wearer, all of the conduits being formed of fabric material in order to minimize movement restrictions and discomfort to the wearer.

16 Claims, 7 Drawing Figures

WEARABLE VENTILATION SYSTEM

BACKGROUND OF THE INVENTION

1. Field of the Invention

The present invention provides a wearable ventilation system for providing a continuous stream of air over a large portion of a person's body which can be used at any time but is most particularly useful under heavy outer garments particularly such as those garments worn as protective outer wear in dangerous industrial environments.

Of particular note is any industrial environment wherein Nitrobenzene is present.

Whenever an employee working in a chemical environment is required to actually enter the environment he must wear one of a variety of presently available industrial rainwear or protective garments. Often the employee will not wear the garment when performing quick and simple operations in the environment and as such the employee is exposed to some element of danger. In order to encourage and employee to wear the garment it would be desirable to make the garment as comfortable as possible to the employee during times of usage as well as making the garment as simple and easy as possible for the employee to put on and take off. In this regard the wearable vent and ventilation system of the present invention provides a means for cooling the skin surface of a person wearing an industrial protective garment in order to provide increased comfort and other associated advantages. In particular the wearable ventilation system provides an auxiliary means for defogging the interior of the face shield of an industrial protective garment.

2. Description of the Prior Art

The currently used air-conditioned protective hoods and clothing are quite bulky and cumbersome and as such users are required to include a cooling or ventilating system whenever these garments are worn for any extended period of time. The ventilating systems currently used are primarily limited to arrays of air hosing and tubing which is bulky and cumbersome to the wearer especially when worn underneath industrial rainwear. Many of these systems also include the holding of an air tank on the back of the wearer in order to make the suit and ventilation system portable, however, none of these systems have proven satisfactory. The more economically made systems merely supply air to the helmet or head and face area and are based on the principle that if you will cool the user's head and face area the user will feel more comfortable all over.

A wearer will refrain from using the ventilation system whenever the assembly of the system requires the placement of numerous hoses, buckles and clamps throughout the surface of a person's body even prior to putting on the heavy industrial protective garment itself.

The present system provides a simple air ventilating system which can be put on in the same time that is required to put on a vest. That configuration is usable with any external garment. However, it is also possible, with the increased comfort achieved by this design, to include the design sewn or otherwise attached to the interior of an industrial protective garment and as such there is no element of discomfort or inconvenience any greater than merely putting on the industrial protective garment itself. The comfort and ease of the system of the present invention is not achieved by the bulky hose configurations and other similar complicated ventilation systems in the prior art, and presently being utilized. The present invention is novel and unique in the use of a fabric material as the means for providing the conduit for communicating the ventilating air to the various locations along the user's arms and legs as well as to the user's head and face area.

SUMMARY OF THE INVENTION

The wearable ventilation system of the present invention is particularly useful when worn under or as an interior portion of an outer garment of industrial protective material such as an industrial rainsuit or the like. The present system allows for the connection of shop air for distribution through the system distribution means or in the alternative cooled or air-conditioned air. To facilitate distribution the present system includes a manifold which receives ventilating gas through a manifold inlet and supplies this ventilating gas to at least one manifold outlet. The manifold outlet is connected to one of a variety of gas distribution means which are formed of a flexible fabric material in order to minimize any movement restrictions or discomfort associated therewith to the wearer. The distribution means is connected in fluid flow communication with the manifold at ports defined within the gas distribution means or conduits.

The gas distribution conduits define a plurality of orifices therein to allow a controlled release of ventilating gas throughout the entire interior of the selected environment to be ventilated. In other words whenever a heavy industrial protective garment is worn the ventilating gas will be directed by the gas distribution conduits to be released through a plurality of orifices which may be approximately pin size which are located along the arms and legs and head and face area of the wearer.

Although the present system is particularly adaptable when used secured to the interior of an industrial protective garment it may also be utilized for other purposes wherein a simple vest structure as shown in FIG. 1 will be usable. Two gas distribution conduits will extend from the lower back area of the wearer where the manifold is located to the front waist area. Also a waist belt or the like may be utilized to secure the manifold to the back of the wearer as well as to buckle in the front and provide a means for securing the gas distribution conduits over the shoulders of the wearer by connecting them at the lower front location to the waist belt itself.

The material of the gas distribution conduits may be any convenient fabric but most particularly and most advantageously can be chosen to be a woven fabric material which is then covered by a gas impervious elastomer layer such as a butyl rubber material in order to eliminate the flow of gas through the walls of the gas distribution conduit except at those pre-chosen locations of the orifices. The material will maintain its completely flexible nature and as such the wearer will not be able to perceive any difference between a garment with or without the conduits. Therefore no restriction in movement or flexibility will be felt by the wearer and therefore discomfort directly related to the gas distribution conduits themselves will be eliminated.

When utilized with an outer protective industrial garment the distribution system may include a head distribution tube which includes enlarged orifices at the forward edges thereof. These enlarged orifices may preferably be located near the face area of the wearer and as such will direct a stream of large air flow volume in the area of the wearer's face and against the interior side of the face visor in order to provide a large volume of fresh air to the face area of the wearer as well as to prevent fogging of the interior surface of the visor of the industrial protective garment.

The manifold of the present design may also be made from a similar material to the coated woven flexible fabric material and as such when the air is supplied to the manifold the manifold will swell on the order of a small pillow and therefore will provide a source of pressurized gas to each of the ports of the gas distribution conduits and cause cooling throughout the selected environment. The individual gas distribution conduits may be formed by a single piece of material folded lengthwise and stiched along the folded edge in order to seal the gas from the conduit except through the orifices. This configuration is shown best in FIG. 2.

It is an object of the present invention to provide a means for ventilating the external surface of a wearer's skin.

It is an object of the present invention to provide a means for cooling the interior environment of an industrial protective garment.

It is an object of the present invention to provide a system for increasing the comfort and use of bulky rainwear.

It is an object of the present invention to provide a completely flexible air distribution system for use supplying and distributing cool air to the surface of a person's skin.

It is an object of the present invention to provide a wearable ventilation system which can be worn under any garment.

It is an object of the present invention to provide an air delivery system which may be secured to the interior surface of an industrial protective garment to cause complete cooling of the internal environment without providing any element of movement restriction or discomfort to the wearer.

It is an object of the present invention to provide a wearable ventilation system made form a coated fabric material which provides a controlled distribution of ventilating or cooled air.

It is an object of the present invention to provide a ventilating system which may include a relief valve in the front of a protective industrial garment.

It is an object of the present invention to provide an industrial rainsuit which includes as an integral internal element thereof a completely flexible and completely efficient ventilation system.

It is an object of the present invention to provide a wearable ventilation system which is more economical to manufacture and simpler to maintain than available heretofore.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
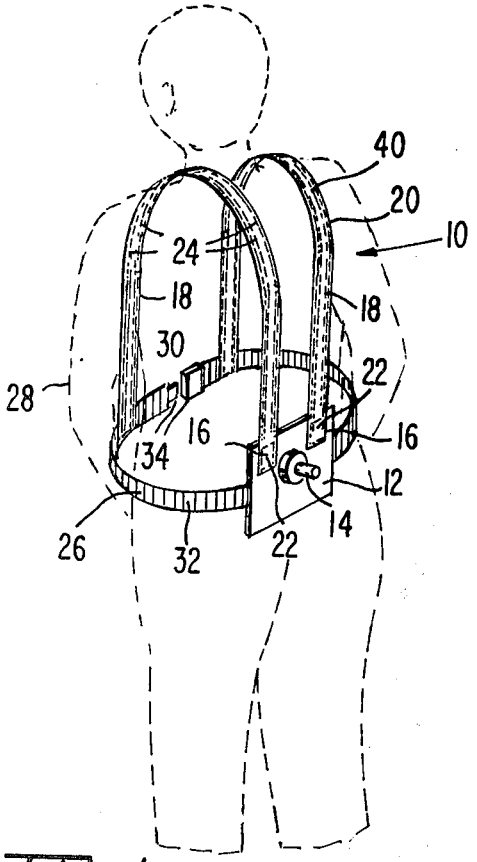
FIG. 1 is a perspective view of an embodiment of a wearable ventilation system of the present invention showing the basic design for use under any external garment.
Figure 7:
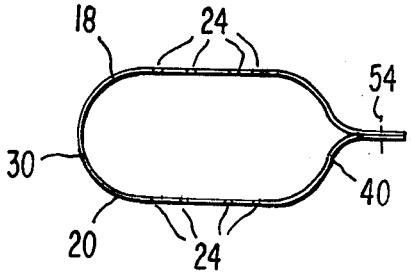
FIG. 7 is a cross-sectional view of an embodiment of the gas distribution conduit of the present invention.

The present invention of a wearable ventilation system 10 may include a manifold 12 which defines therein a manifold inlet means 14 and a manifold outlet means 16. The inlet 14 is adapted to be connected to a gas supply source or cooled air supply source to admit this ventilating air into the interior of the manifold 12. Preferably the manifold 12 will be formed of a flexible fabric material and as such will expand like a small pillow in response to the entry of ventilating air therein.

At least a plurality of gas distribution means or conduits 18 may be connected to the manifold outlets 16 in order to receive ventilating air therefrom and communicate the air to the environment which is desired to be cooled or ventilated. Preferably the gas distribution conduits 18 will be formed from a flexible fabric material 20 in order to minimize discomfort and movement restrictions.

The manifold outlets will be adapted to connect and be registrable with ports 22 defined in the gas distribution conduit. In this manner ventilating air will flow from the manifold 12 through the manifold outlet 16 and port 22 into the gas distribution conduit 18.

The gas distribution conduits 18 may be positioned throughout the ventilated environment. Whenever the present system is used with an external fabric in order to cool the wearer of that fabric the system will preferably include arm distribution conduits 50 and leg distribution conduits 52 in order to communicate the ventilating air to the extremities of the user. The ventilating itself is achieved by the emitting of ventilating gas through a plurality of tiny orifices 24 which may be as small as pinholes which are located throughout the flexible fabric material 20 of the gas distribution conduits 18. In order to eliminate unwanted loss of ventilating air through the flexible fabric material 20 the use of a gas sealing substance 30 such as a coating of butyl rubber may be applied to the flexible fabric material 20 in order to make it impervious to flow of gas therethrough. In this manner the only release of ventilating or cooled air will be made at the pre-selected orifices 24. It should be appreciated that for the purpose of this disclosure the term fabric material is defined to be any woven or non-woven material which is capable of defining orifices 24 and is capable of being generally flexible when worn by a user.

The basic wearable ventilation system 10 shown in FIG. 1 can be used worn under any garment and has the general attachment means 26 which in this case is shown as a waist belt 32 and a front buckling means 34. In this manner the system 10 is secured to the wearers body 28. Other forms of attachment means 26 are within the contemplation of this invention but such configurations are not shown in detailed from herein.

Figure 4:
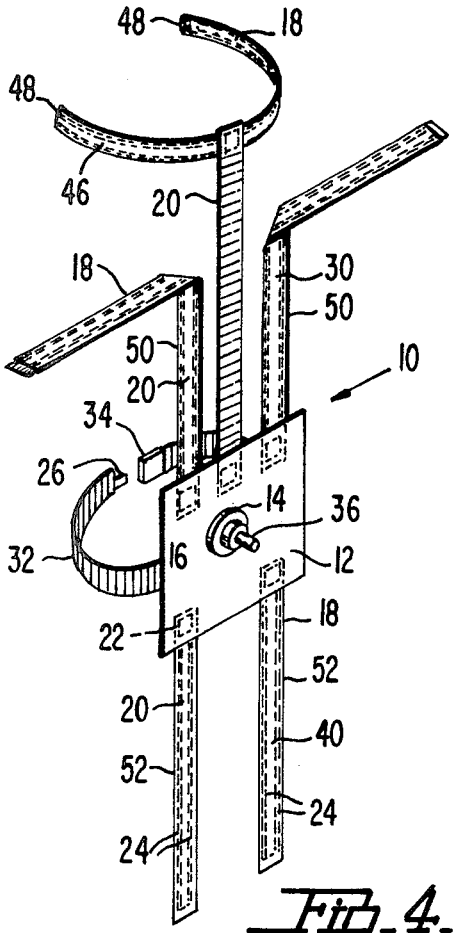
FIG. 4. is a perspective view of an embodiment of a gas distribution system usable secured to the interior of an outer protective garment.
Figure 5:
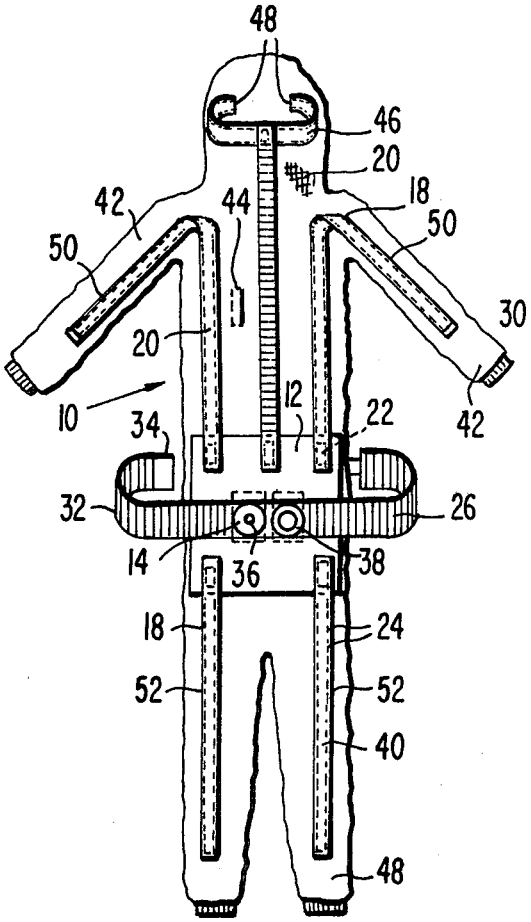
FIG. 5 is an illustration of an embodiment of a gas distribution system shown secured within an industrial protective suit.
Figure 6:
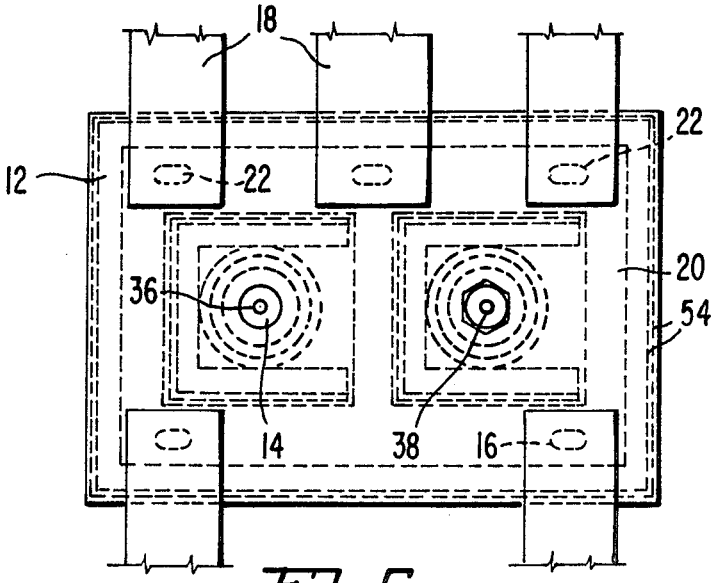
FIG. 6 is a front view of an embodiment of a manifold of the present invention.

In order to increase the various systems with which the present ventilation system is utilized the manifold 12 may include a shop air inlet connection 36 as well as a pre-cooled air inlet connection or vortex connection 38. These systems are particularly useful whenever the present system is utilized within an outer garment 42 of protective material. Whenever such an outer garment is used it is also desirable to include a relief valve 44 therein in order to release the buildup of internal pressure and to increase the flow of ventilating gas through the orifices 24. Also when utilized with outer garments of industrial protective clothing it is desirable to include a headband distribution conduit 46 as best shown in FIG. 4 which may include oversized orifices 48 in the front section thereof to increase the amount of ventilated or pre-cooled air supplied to the face and head area of the wearer as well as to aid in defogging the interior of a face shield which may be an integral part of the outer protective garment.

Figure 2:
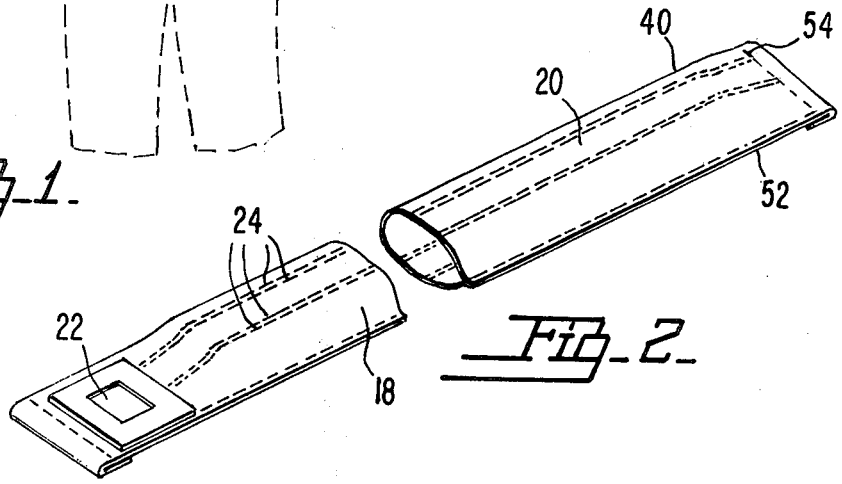
FIG. 2 is a perspective view of an embodiment of a gas distribution conduit of the present invention.
Figure 3:
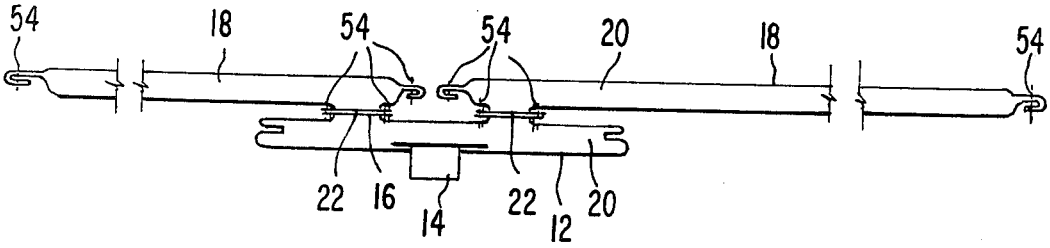
FIG. 3 is a cross-sectional view of the inter-connection between embodiments of the manifold and gas distribution conduits of the present invention.

It is one of the primary inventive characteristics of the present system to utilize a woven fabric conduit 40 or other fabric conduit 18 to distribute the ventilating gas to peripheral areas of the body without utilizing a cumbersome tubing structure or other configuration which would inhibit the movement characteristics of the user. This design is achieved by making the gas distribution conduits 18 from a flexible fabric material 20 which may be formed by the folding over of long strips of material and the placement of stiches 54 running lengthwise thereof as best shown in FIGS. 2 and cross-sectional FIG. 3.

Another advantage of the use of elastomer coated flexible fabric material to control the distribution of air is the minimization of abrasion or friction resistance which is another aid in comfort to the wearer as well as minimizing of the wearing of the material of the suit itself. While this is an additional advantage it should be appreciated that the main advantage of the present system is the ability to use a ventilating system as a separate entity or as an integral element of a suit while imparting to the wearer no perceptible movement restrictions.

While particular embodiments of this invention have been shown in the drawings and described above, it will be apparent, that many changes may be made in the form, arrangement and positioning of the various settlements of the combination. In consideration thereof it should be understood that preferred embodiments of this invention disclosed herein are intended to be illustrative only and not intended to limit the scope of the invention.

I claim:

1. A wearable ventilation system comprising:
(a) a manifold of fabric material for receiving a ventilating gas and distributing same for ventilation;
(b) manifold inlet means defined in said manifold for receiving ventilating gas from a source and directing the flow of the gas into said manifold;
(c) manifold outlet means defined in said manifold to direct the ventilating gas for distribution; and
(d) gas distribution means formed of a flexible fabric material impregnated throughout with an elastomeric substance to prevent complete ventilation through the flexible fabric walls of said gas distribution means by preventing ventilating gas flow through the fabric material itself except at preselected desired locations, said gas distribution means defining a plurality of orifices therein to allow only controlled release of ventilating gas, only at preselected locations, through to the ventilated environment, said elastomer impregnated fabric material providing a flexibly walled gas distribution means in order to minimize movement restrictions and discomfort of the wearer, said gas distribution means connected in fluid flow communication with said manifold for receiving and distributing ventilating gas therefrom, said gas distribution means defining at least one port means therein to be positioned adjacent said manifold outlet means to facilitate said gas distribution means in receiving of ventilated gas from said manifold.

2. The system as defined in claim 1 further comprising an attachment means adapted to secure the system to the interior of a garment to be worn by a person.

3. The system as defined in claim 1 further comprising an attachment means adapted to secure the system to a person's body.

4. The system as defined in claim 3 wherein said attachment means comprises a waist belt including a buckling means in the front thereof and secured to the manifold in the rear area thereof and being adapted to fit around the waist of the wearer, also said gas distribution means comprising at least two gas distribution conduits extending upward from said manifold and adapted to be placed across the shoulders of the wearer to be attached to the front area of the waist belt.

5. The system as defined in claim 1 wherein said manifold inlet means includes inlet connections for shop air as well as pre-cooled air to selectively control the temperature of air being discharged from the system.

6. The system as defined in claim 1 wherein said gas distribution means comprises at least one woven fabric conduit.

7. For use with an outer garment of protective material such as an industrial rain suit to ventilate the wearer's body, a wearable ventilation system comprising:
(a) a manifold of fabric material for receiving ventilating gas and distributing same through the interior of the outer garment for ventilation thereof;
(b) manifold inlet means defined in said manifold for receiving of ventilating gas;
(c) manifold outlet means defined in said manifold to direct distribution of the ventilating gas throughout the interior of the outer garment; and
(d) gas distribution means formed of a flexible fabric material impregnated throughout with an elastomeric substance to prevent complete ventilation through the flexible fabric walls of said gas distribution means by preventing ventilating gas flow through the fabric material itself except at preselected desired locations, said gas distribution means defining a plurality of orifices therein to allow only controlled release of ventilating gas, only at preselected locations, through to the ventilated environment, said elastomeric impregnated fabric material providing a flexibly walled gas distribution means in order to minimize movement restriction and discomfort or the wearer, said gas distribution means connected in fluid flow communication with said manifold for receiving ventilating gas and distributing same throughout the interior of the outer environment, said gas distribution means defining at least one port means therein to be positioned adjacent said manifold outlet means to receive gas therefrom for flow to said gas distribution means.

8. The system as defined in claim 7 wherein the ventilating system is attached to the interior of the outer protective garment.

9. The system as defined in claim 7 wherein said gas distribution means and said manifold are formed of the same material as said outer protective garment.

10. The system as defined in claim 7 wherein said manifold inlet means includes inlet connections for shop air as well as pre-cooled air to selectively control the temperature of air being discharged from the system.

11. The system as defined in claim 7 wherein said gas distribution means comprises at least one woven fabric conduit.

12. The system as defined in claim 7 further comprising a relief valve located in the outer garment to release gas pressure built up within the outer garment and facilitate discharge flow of ventilating gas.

13. The system as defined in claim 7 wherein said gas distribution means extends along the arms of the interior of the outer garment.

14. The system as defined in claim 7 wherein said gas distribution means extends along the legs of the interior of the outer garment.

15. The system as defined in claim 7 wherein said gas distribution means includes a headband distribution conduit extending around the head of the wearer inside of the outer garment to facilitate ventilation of the head area.

16. The system as defined in claim 15 wherein said headband distribution conduit includes at least one oversized orifice in the face area to provide increased ventilation and eliminate fogging of the interior of a face mask of the protective garment.

* * * * *